US010556765B2

(12) United States Patent
Herrmann et al.

(10) Patent No.: US 10,556,765 B2
(45) Date of Patent: Feb. 11, 2020

(54) REGISTRATION SYSTEM WITH INDEPENDENT LATERALLY ADJUSTABLE NIPS

(71) Applicant: Xerox Corporation, Norwalk, CT (US)

(72) Inventors: Douglas K. Herrmann, Webster, NY (US); Seemit Praharaj, Webster, NY (US); Jason Mathew LeFevre, Penfield, NY (US); Paul J. McConville, Webster, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/922,256

(22) Filed: Mar. 15, 2018

(65) Prior Publication Data

US 2019/0283999 A1 Sep. 19, 2019

(51) Int. Cl.

| | |
|---|---|
| ***B65H 9/00*** | (2006.01) |
| ***B65H 9/20*** | (2006.01) |
| ***B41J 11/00*** | (2006.01) |
| ***B41J 13/30*** | (2006.01) |
| ***B41J 13/26*** | (2006.01) |

(52) U.S. Cl.

CPC ..... *B65H 9/002* (2013.01); *B41J 11/0095* (2013.01); *B41J 13/30* (2013.01); *B65H 9/20* (2013.01); *B41J 13/26* (2013.01); *B65H 2404/1523* (2013.01); *B65H 2404/1526* (2013.01); *B65H 2404/1544* (2013.01)

(58) Field of Classification Search

CPC .. B65H 9/002; B65H 9/20; B65H 2404/1544; B65H 2404/1523; B65H 2404/1526

See application file for complete search history.

(56) References Cited

U.S. PATENT DOCUMENTS

| | | | | |
|---|---|---|---|---|
| 5,219,159 | A * | 6/1993 | Malachowski | B65H 9/002 271/228 |
| 7,607,660 | B2 * | 10/2009 | Inoue | B65H 9/002 271/228 |
| 7,686,299 | B2 * | 3/2010 | Herrmann | B65H 9/12 271/228 |
| 7,845,635 | B2 * | 12/2010 | Herrmann | B65H 7/02 271/226 |
| 8,056,897 | B2 * | 11/2011 | deJong | B65H 9/002 271/227 |
| 8,292,293 | B2 * | 10/2012 | Inoue | B65H 9/002 271/227 |
| 2010/0123284 | A1 | 5/2010 | Herrmann | |
| 2012/0319347 | A1 * | 12/2012 | Moore | B65H 5/004 271/12 |

* cited by examiner

*Primary Examiner* — Patrick Cicchino

(57) ABSTRACT

A registration system for a printing device and a method for controlling the same are disclosed. For example, the registration system includes at least one sensor to detect a position of a print media, at least one laterally adjustable nip, wherein the laterally adjustable nip moves along an inboard direction and an outboard direction, a motor coupled to the at least one laterally adjustable nip to move the at least one laterally adjustable nip a desired amount of movement based on the position of the print media and a width of the print media, and a processor communicatively coupled to the at least one sensor and the motor to calculate a desired amount of movement based on the position of the print media and control the motor to move the at least one laterally adjustable nip by the desired amount of movement.

13 Claims, 5 Drawing Sheets

REGISTRATION SYSTEM WITH INDEPENDENT LATERALLY ADJUSTABLE NIPS

The present disclosure relates generally to printing devices and, more particularly, to registration systems within the printing devices having independent laterally adjustable nips.

BACKGROUND

Printing devices can be used to print images on print media. The print media can be fed through the printing device along a transport path and imaging path to have the image printed. Along the transport path and the imaging path, there are certain locations where processing errors can occur that can cause a misalignment of the image relative to the print media.

For example, the print devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

SUMMARY

According to aspects illustrated herein, there are provided a registration system for a printing device and a method for controlling the same. One disclosed feature of the embodiments is a registration system for a printing device comprising at least one sensor to detect a position of a print media, at least one laterally adjustable nip, wherein the laterally adjustable nip moves along an inboard direction and an outboard direction, a motor coupled to the at least one laterally adjustable nip to move the at least one laterally adjustable nip a desired amount of movement based on the position of the print media and a width of the print media, and a processor communicatively coupled to the at least one sensor and the motor to calculate a desired amount of movement based on the position of the print media and control the motor to move the at least one laterally adjustable nip by the desired amount of movement.

Another disclosed feature of the embodiments is a method for controlling a position of a print media in a registration system of a printing device. In one embodiment, the method detects a position of a print media, determines a width of the print media, determines an amount of movement of at least one laterally adjustable nip based on the position and the width of the print media, and moves the at least one laterally adjustable nip in a lateral direction and in a rotational direction based on the amount of movement that is determined based on the position and the width of the print media.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to independent laterally adjustable nips in a registration system and a method for registering a print media using the independent laterally adjustable nips. As discussed above, print devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

Registration systems may include center registered systems and edge registered systems. Current designs for some registration systems require the use of three nips. A center nip may be vertically movable (e.g., up and down). As a result, for smaller sheets of print media, the center nip may be moved down to engage the print media. For larger sheets of print media, the center nip may be moved up to disengage the print media and allow the outer two nips to engage the print media. However, if a sheet of print media that is sized between the smallest sheet and the largest sheet is received, the registration system may have difficulty handling the print media.

In addition, the nips in the registration system may be spaced to handle the smallest sized print media. However, this may cause one of the nips to be located more towards a center of along a width of the paper path or both nips may be located offset to one side of the paper path. When the nips are in fixed locations, and a sheet that is smaller than the largest expected size and larger than the smallest expected size of print media is received, the location of the nips may not be ideal for aligning the print media.

Embodiments of the present disclosure provide a laterally adjustable nip that can allow the nips to be optimally located to handle the largest sized print media that can be fed for a particular printing device. For example, at least one of the nips may move laterally (e.g., inboard away from a user at the printing device or outboard towards a user at the printing device) to allow both nips to be on the outermost margins or edges of the print media. In one embodiment, both nips may be laterally adjustable. Thus, laterally adjustable nips may improve print media registration in printing devices to provide better lateral control and skew control of the print media.

In addition, the design of the present disclosure eliminates the need for a third nip. As a result, cost savings can be observed by using only two nips in the registration system.

Figure 1:
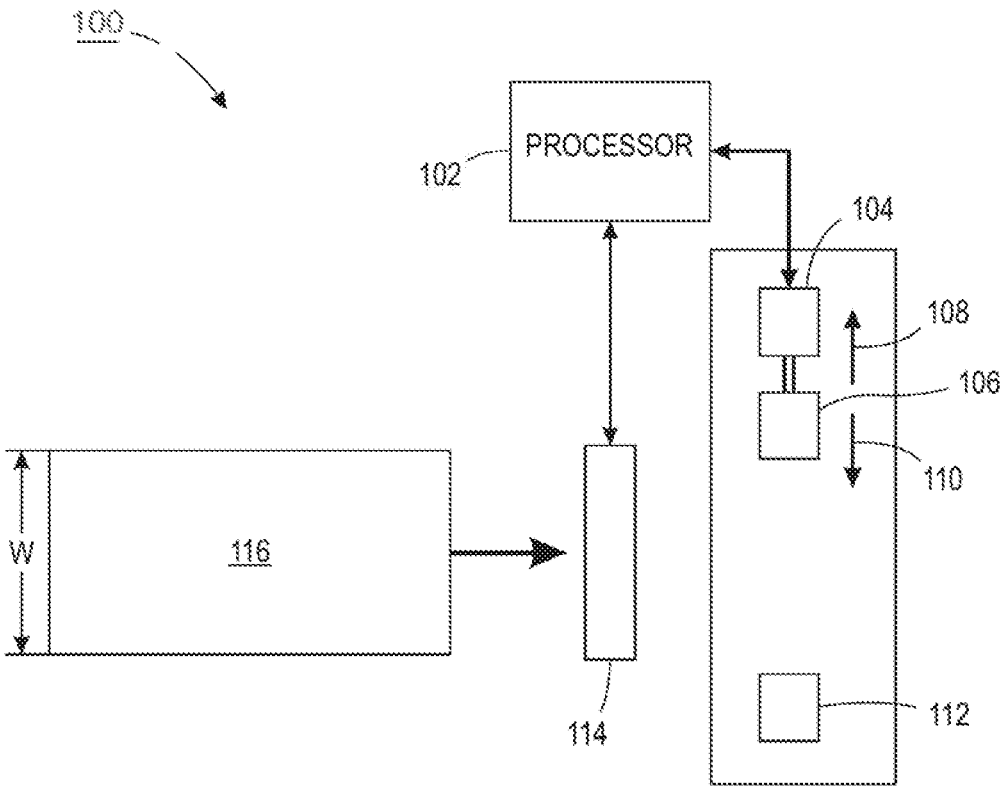
FIG. 1 illustrates a block diagram of example registration system of the present disclosure.

FIG. 1 illustrates a block diagram of an example registration system 100 of the present disclosure. The registration system 100 may be part of a printing device. For example, the registration system 100 may be used to align a print media 116 such that an image is correctly printed on the print media 116. In other words, the registration system 100 may correctly align and position the print media 116 relative to an imaging system that is further downstream from the registration system 100.

FIG. 1 has been simplified to show a block diagram of the registration system 100 of the printing device. However, it should be noted that the printing device may include a variety of other subsystems such as a paper feed, one or more components that comprise the transport path, the imaging subsystem that may include toner or printheads, a finishing module that may staple, collate, or stack processed print media 116, and the like.

In one embodiment, the registration system 100 may include a processor 102, a motor 104, a laterally adjustable nip 106, and at least one sensor 114. The processor 102 may be communicatively coupled to the motor 104 and the at least one sensor 114.

In one embodiment, the sensor 114 may be used to detect a position of an incoming sheet of the print media 116. The position may refer to a lateral position (e.g., along a width of the registration system 100 or relative to the inboard side and outboard side of the registration system 100) and a skew. The lateral position and skew are discussed in further detail below.

The print media 116 may have a width "w" as illustrated in FIG. 1. The width of the print media 116 may be selected by a user via a user interface of the printing device that the registration system 100 is located inside of. In another example, the sensor 114 may be used to automatically detect a width of the print media 116.

In one embodiment, the processor 102 may be communicatively coupled to the motor 104 and the sensor 114. The processor 102 may be used to calculate an amount of movement that the laterally adjustable nip 106 should be moved based on the position of the print media 116 received from the sensor 114 (e.g., the lateral position and/or the skew) and the width of the print media 116.

In one embodiment, the amount of movement may include a lateral movement and a rotational movement. The laterally adjustable nip 106 may be moved along a lateral direction based on the width of the print media 116. The lateral direction may include an inboard direction 108 or an outboard direction 110. The laterally adjustable nip 106 may be moved such that a spacing between a second nip 112 and the laterally adjustable nip 106 may be approximately equal to a width of the print media 116. As a result, the nip 106 may handle the print media 116 along the edges of the print media 116 to provide better handling of the print media 116.

The rotational movement may include rotating the laterally adjustable nip 106 around a center axis of the laterally adjustable nip 106 at different rotational speeds. The different rotational speeds may provide control of the skew, and in some instances, control the lateral position of the print media 116. In other embodiments, a movable registration carriage may be used to control the lateral position, as discussed below.

In one embodiment, the movement may be performed by controlling the motor 104. As discussed in further detail below, the laterally adjustable nip 106 may be moved along an inboard direction or an outboard direction via the motor 104. The motor 104 may also control a rotational speed of the laterally adjustable nip 106. It should be noted that FIG. 1 has been simplified and that the motor 104 maybe deployed as separate motors to control the lateral movement of the laterally adjustable nip 106 and the rotational speed of the laterally adjustable nip 106.

The laterally adjustable nip 106 and the second nip 112 may be fabricated from any type of material that can grip the print media 116. In one embodiment, the material of the laterally adjustable nip 106 and the second nip 112 may be a rubber material or a plastic material.

Figure 2:
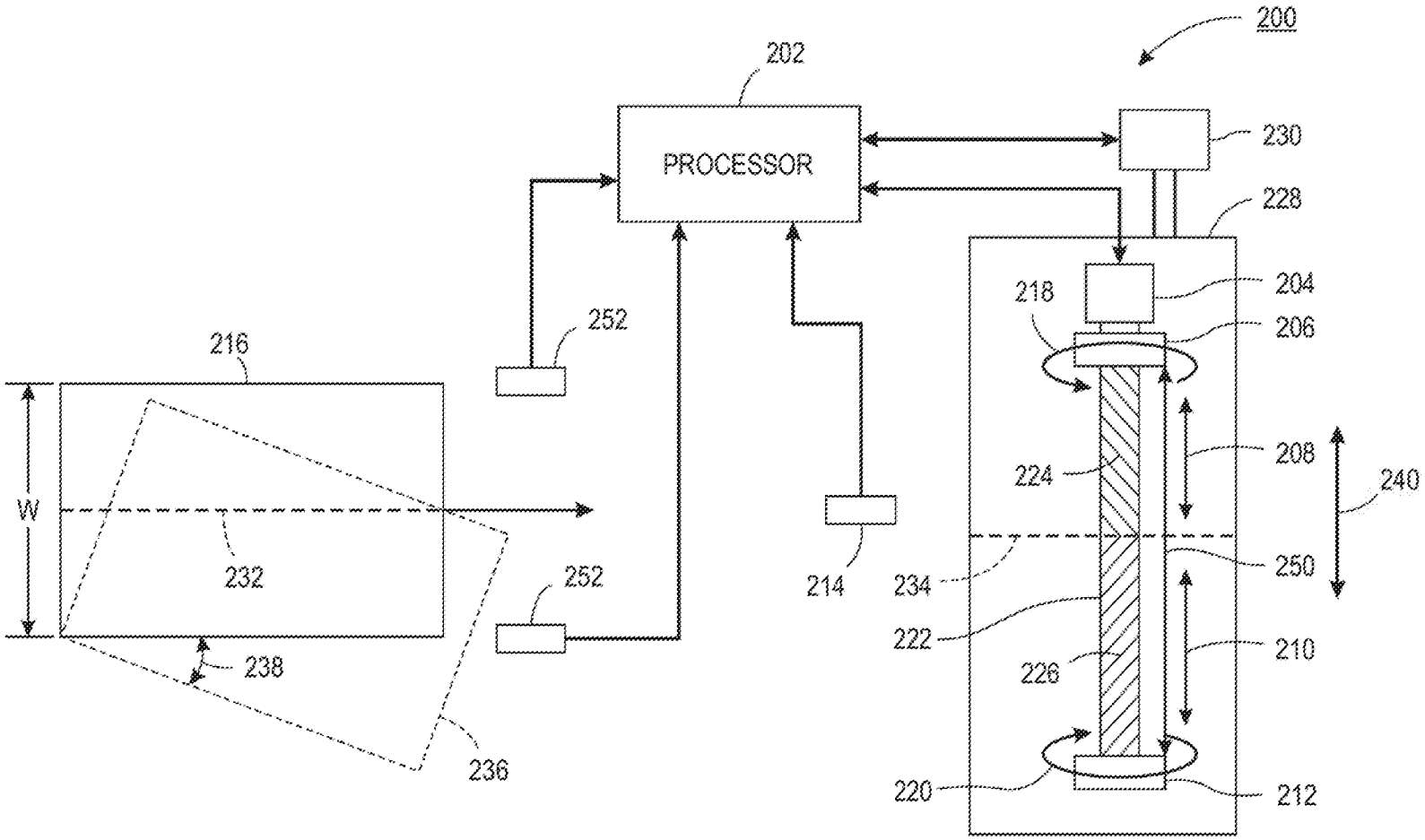
FIG. 2 illustrates a top view of an example center registered registration system of the present disclosure.

FIG. 2 illustrates a top view of an example of a center registered registration system 200 of the present disclosure. In one embodiment, the registration system 200 may also be part of a printing device that center aligns a print media 216.

In one embodiment, the registration system 200 may include a processor 202, a motor 204, a laterally adjustable nip 206, a centerline sensor 214, and a pair of sensors 252. In addition, the registration system 200 may include a second motor 230 that is coupled to movable registration carriage 228. The processor 202 may be communicatively coupled to the motor 204, the second motor 230, the centerline sensor 214, and the pair of sensors 252.

In one embodiment, the pair of sensors 252 may be located upstream from the at least one laterally adjustable nip 206 and be used to measure the skew of the print media 216. For example, the skew may represent how much the print media 216 is angled. Dashed lines 236 illustrate how the print media 216 may be skewed. An angle 238 may measure the amount of skew. The pair of sensors 252 may measure the skew based on a timing of when each sensor detects a leading edge of the print media 216. For example, if the pair of sensors 252 detects a leading edge of the print media 216 at the same time, there is no skew. However, if the inboard sensor 252 detects the leading edge before the outboard sensor 252 detects the leading edge, then the print media 216 may be skewed. The measurement of the skew may be transmitted to the processor 202.

In one embodiment, the centerline sensor 214 may be located upstream from the at least one laterally adjustable nip 206 and be used to measure a lateral position of the print media 216. In one embodiment, the centerline sensor 214 may be located downstream from the pair of sensors 252. The lateral position of the print media 216 may be transmitted to the processor 202. The processor 202 may then calculate the amount of movement of the laterally adjustable nip 206 based on the skew, the lateral position, and the width of the print media 216.

In one embodiment, the lateral position may be adjusted, or corrected, by moving the second motor 230 to move the movable registration carriage 228 along an inboard direction or an outboard direction as shown by an arrow 240. The movable registration carriage 228 may be moved to align a centerline 234 of the movable registration carriage 228 with a centerline 232 of the print media 216.

In one embodiment, the laterally adjustable nip 206 may be moved such that a spacing 250 between the laterally adjustable nip 206 and a second nip 212 is approximately equal to the width of the print media 216. In one embodiment, a lead screw 222 may be coupled through a center axis of the laterally adjustable nip 206. The lead screw 222 may be coupled to the motor 204. Activation of the motor 204 may cause the laterally adjustable nip 206 to move laterally along an inboard direction or an outboard direction as shown by an arrow 208 via pitch lines 224.

In one embodiment, the second nip 212 may be a fixed nip that does not move. In another embodiment, the second nip 212 may also be a laterally adjustable nip. In other words, the second nip 212 may also be moved laterally along an inboard direction or an outboard direction as shown by an arrow 210. The second nip 212 may be aligned with the laterally adjustable nip 206 along opposite ends of the lead screw 222.

For example, the second nip 212 and the laterally adjustable nip 206 may be coupled to opposite ends of the lead screw 222. The lead screw 222 may have opposing pitch lines 224 and 226. As a result, when the lead screw 222 is rotated by the motor 204, the laterally adjustable nip 206 and the second nip 212 may move in opposite directions. For example, when the lead screw 222 is rotated in a first direction, the laterally adjustable nip 206 and the second nip 212 may move towards each other along the lead screw 222. When the lead screw 222 is rotated in a second direction the laterally adjustable nip 206 and the second nip 212 may move away from each other along the lead screw 222.

In one embodiment, the laterally adjustable nip 206 and the second nip 212 may be on separate lead screws 222 that have different motors 204. In other words, the laterally adjustable nip 206 and the second nip 212 may have respective lead screws that are independently rotatable. As a result the laterally adjustable nip 206 and the second nip 212 may be independently adjustable. Said another way, the laterally adjustable nip 206 and the second nip 212 may be moved separately and independently from one another.

In one embodiment, the motor 204 may include separate motor components. For example, the motor 204 may include a stepper motor that controls rotation of the lead screw 222 and a drive motor that controls rotation (e.g., the rotational speed) of the laterally adjustable nip 206. Similarly, in embodiments where the second nip 212 is also laterally adjustable, the second nip 212 may also have a respective drive motor that controls the rotation of the second nip 212.

In other words, the rotation of the laterally adjustable nip 206 and the second nip 212 (e.g., as shown by an arrow 218 and an arrow 220, respectively) can also be controlled. The rotational speed, as controlled by the rotation of the laterally adjustable nip 206 and/or the second nip 212 around the lead screw 222 may provide control of the skew of the print media 216. For example, rotating the laterally adjustable nip 206 faster than the second nip 212 may adjust the skew in one direction. Rotating the laterally adjustable nip 206 slower than the second nip 212 may adjust the skew in an opposite direction.

Thus, the center registered registration system 200 may provide at least one laterally adjustable nip 206 that may provide a more efficient handling of the print media 216. As noted above, the laterally adjustable nip 206 may allow only two nips 206 and 212 to be deployed without requiring a third nip as used in current center registered designs. In addition, the laterally adjustable nip 206 allows the nips 206 and 212 to be properly spaced to handle the print media 216 by the outer edges to provide the most efficient handling of the print media 216. In other words, force can be more evenly distributed by the nips 206 and 212 around the centerline 232 of the print media 216 no matter the width of the print media 216.

Figure 3:
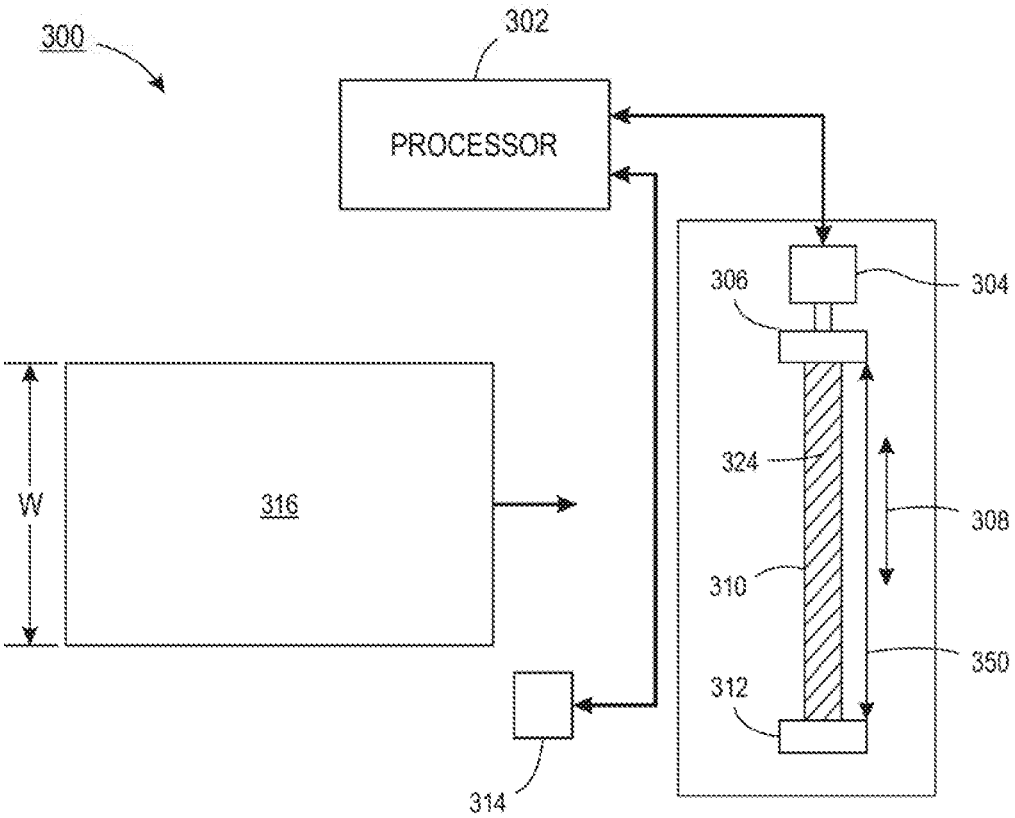
FIG. 3 illustrates a top view of an example edge registered registration system of the present disclosure.

FIG. 3 illustrates a top view of an example of an edge registered registration system 300. In one embodiment, the registration system 300 may also be part of a printing device that edge aligns a print media 316.

In one embodiment, the registration system 300 may include a processor 302, a motor 304, a laterally adjustable nip 206, and a charge coupled device (CCD) sensor 314. The processor 302 may be communicatively coupled to the motor 304 and the CCD sensor 314.

In one embodiment, the CCD sensor 314 may be located upstream from the laterally adjustable nip 306 and coupled along a side that the print media 316 may be aligned to. For example, if the print media 316 is aligned along an outboard side of the registration system 300, the CCD sensor 314 may be coupled to the outboard side, or vice versa. The CCD sensor 314 may detect a position of the print media 316 (e.g., a lateral position and/or a skew).

The position of the print media 316 may be transmitted to the processor 302. The processor 302 may then calculate the amount of movement of the laterally adjustable nip 306 base on the skew, the lateral position, and the width of the print media 316.

In one embodiment, the laterally adjustable nip 306 may be moved such that a spacing 350 between the laterally adjustable nip 306 and a second nip 312 is approximately equal to the width of the print media 316. In one embodiment, a lead screw 310 may be coupled through a center axis of the laterally adjustable nip 306. The lead screw 310 may be coupled to the motor 304. Activation of the motor 304 may cause the laterally adjustable nip 306 to move laterally along an inboard direction or an outboard direction as shown by an arrow 308 via pitch lines 324.

In one embodiment, the second nip 312 may be fixed along a side that the print media 316 is aligned to. For example, if the print media 316 is aligned with an outboard side of the registration system 300, then the second nip 312 may be fixed to the outboard side of the registration system 300, or vice versa. The second nip 312 may be aligned with the laterally adjustable nip 306 on opposite ends of the lead screw 310.

In one embodiment, the motor 304 may also comprise different motor components. For example, the motor 304 may be deployed as a stepper motor that controls rotation of the lead screw 310 and a drive motor that controls rotation (e.g., the rotational speed) of the laterally adjustable nip 306. The lateral position and the skew may be adjusted and/or controlled by controlling the rotation (e.g., spinning the around a center axis or around the lead screw 310) of the laterally adjustable nip 306. For example, spinning one edge of the print media 316 fast enough may provide lateral movement, and simultaneously, provide skew adjustment.

Thus, the edge registered registration system 300 may provide at least one laterally adjustable nip 306 that may provide a more efficient handling of the print media 316. As noted above, the laterally adjustable nip 306 may allow only two nips 306 and 312 to be deployed without requiring a third nip as used in current center registered designs. In addition, the laterally adjustable nip 306 allows the nips 306 and 312 to be properly spaced to handle the print media 316 by the outer edges to provide the most efficient handling of the print media 316. In other words, force can be more evenly distributed by the nips 306 and 312 around the centerline of the print media 316 no matter the width of the print media 316.

Figure 4:
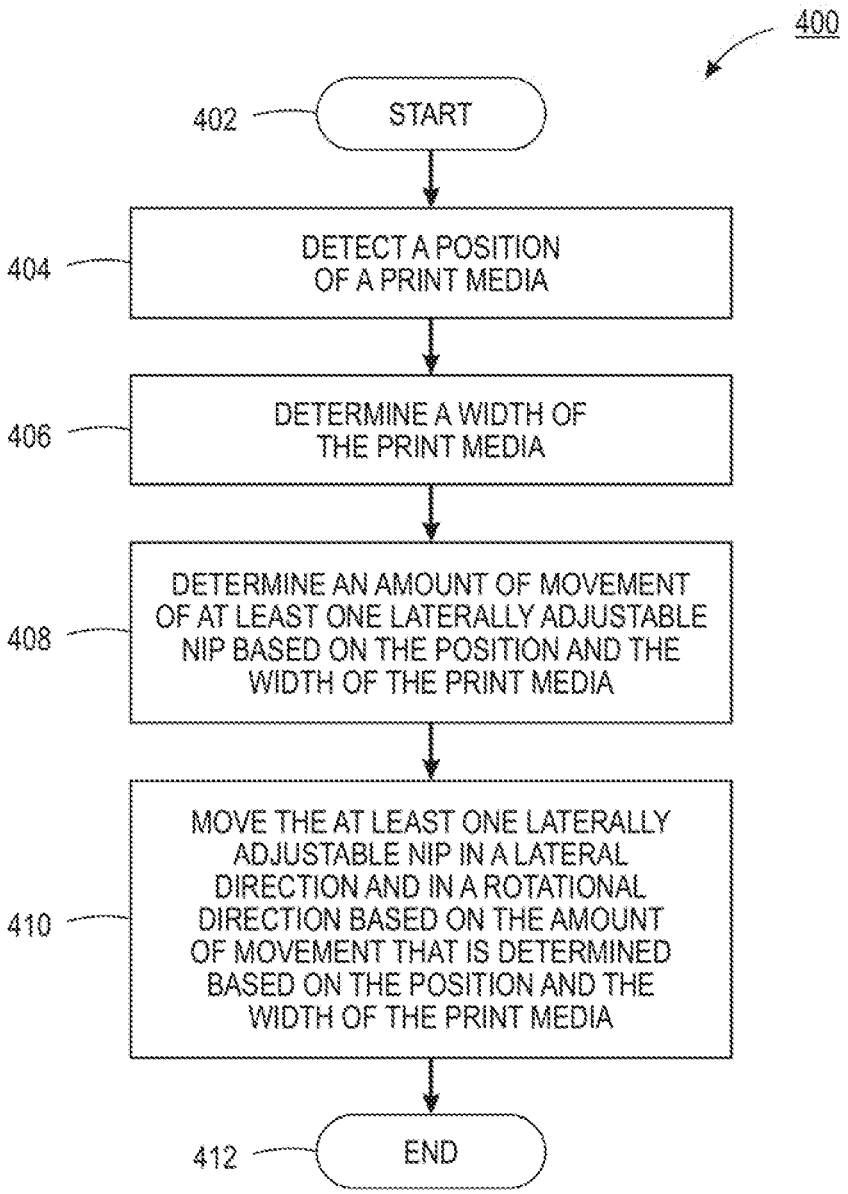
FIG. 4 illustrates a flowchart of an example method for controlling a position of a print media in a registration system of a printing device.
Figure 5:
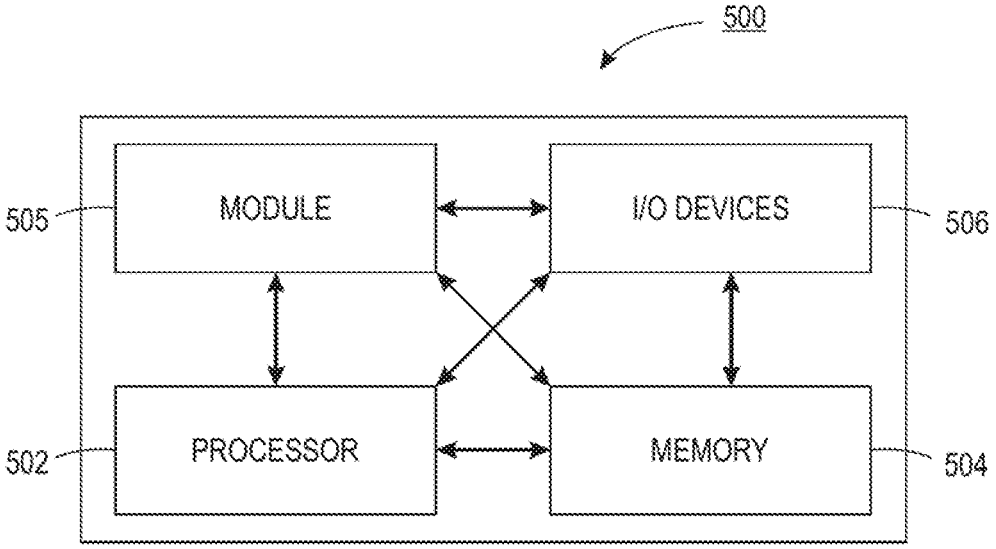
FIG. 5 illustrates a high-level block diagram of an example computer suitable for use in performing the functions described herein.

FIG. 4 illustrates a flowchart of an example method 400 for controlling a position of a print media in a registration system of a printing device. In one embodiment, one or more steps or operations of the method 400 may be performed by the registration system 100, 200, 300, or a computer/processor that controls operation of the systems 100, 200, and 300 as illustrated in FIG. 5 and discussed below.

At block 402, the method 400 begins. At block 404, the method 400 detects a position of a print media. For example, the position may be detected by at least one sensor. The position may include a lateral position and a skew of the print media.

In one embodiment, for a center registered registration system the skew may be detected by a pair of sensors, as described above. The lateral position may be detected by a centerline sensor. In one embodiment, for an edge registered registration system the skew and the lateral position may be detected by a CCD sensor that is coupled to a side of the edge registered registration system.

At block 406, the method 400 determines a width of the print media. In one embodiment, the width may be provided by a user via a user interface of the printing device that contains the registration system. In another embodiment, the width may be automatically detected by a sensor in the registration system.

At block 408, the method 400 determines an amount of movement of at least one laterally adjustable nip based on the position and the width of the print media. In one embodiment, the movement may include a lateral movement and a rotational movement. The amount of lateral movement may be based on a width of the print media.

The amount of rotational movement may be based on an amount of skew. For example, the amount of rotational movement may be the rotational speed of the laterally adjustable nip to adjust the skew of the print media. For edge registered registration systems, the rotation movement may also be used to correct the lateral position.

In one embodiment, for a center registered registration system, the method 400 may also determine an amount of movement for a movable registration carriage. For example, the movable registration carriage may be moved laterally to correct a lateral position of the print media, as described above.

At block 410, the method 400 moves the at least one laterally adjustable nip in a lateral direction and in a rotational direction based on the amount of movement that is determined based on the position and the width of the print media. In one embodiment, the lateral direction may be an inboard direction (e.g., away from a user standing in front of the printing device) or an outboard direction (e.g., towards a user standing in front of the printing device).

For example, the laterally adjustable nip may be moved along an inboard direction or an outboard direction such that a spacing between the laterally adjustable nip and a second nip is approximately equal to a width of the print media. As a result, the laterally adjustable nip and the second nip may be spaced to hold the print media along the outer edges of the print media. The laterally adjustable nip allows the nip to be moved to provide any spacing associated with different widths of different print media.

In one embodiment, the movement in the rotational direction may include a rotational speed of the laterally adjustable nip. The rotational speed may be based on a skew and/or the lateral position that is determined by the sensors. For example, moving the laterally adjustable nip slower or faster than the second nip may provide skew adjustment. For edge registered registration systems, the rotational speed may also provide lateral position adjustments. For center registered registration systems, the lateral position adjustment may be performed by movement of a movable registration carriage, as described above.

In one embodiment, two laterally adjustable nips may be deployed in the registration system. For example, the two laterally adjustable nips may move towards one another or away from one another along a lead screw based on the width of the print media. The rotational direction or speed may also be independently controlled to rotate the two laterally adjustable nips separately or at different speeds to provide skew adjustments and/or lateral position adjustments.

In one embodiment, after the print media passes through the registration system, the laterally adjustable nip and the second nip may return to a default position to prepare for a subsequent sheet of print media. In one example, the default position may be a spacing for a widest possible print media. In another example, the default position may be a spacing for a narrowest sheet of print media. At block 412, the method 400 ends.

It should be noted that the blocks in FIG. 4 that recite a determining operation or involve a decision do not necessarily require that both branches of the determining operation be practiced. In other words, one of the branches of the determining operation can be deemed as an optional step. In addition, one or more steps, blocks, functions or operations of the above described method 400 may comprise optional steps, or can be combined, separated, and/or performed in a different order from that described above, without departing from the example embodiments of the present disclosure.

FIG. 5 depicts a high-level block diagram of a computer that is dedicated to perform the functions described herein. As depicted in FIG. 5, the computer 500 comprises one or more hardware processor elements 502 (e.g., a central processing unit (CPU), a microprocessor, or a multi-core processor), a memory 504, e.g., random access memory (RAM) and/or read only memory (ROM), a module 505 for controlling a position of a print media in a registration system of a printing device, and various input/output devices 506 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the registration systems 100, 200, or 300). For example, computer readable instructions pertaining to the method(s) discussed above can be used to configure a hardware processor to perform the steps, functions and/or operations of the above disclosed methods. In one embodiment, instructions and data for the present module or process 505 for controlling a position of a print media in a registration system of a printing device (e.g., a software program comprising computer-executable instructions) can be loaded into memory 504 and executed by hardware processor element 502 to implement the steps, functions or operations as discussed above in connection with the example method 400. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for controlling a position of a print media in a registration system of a printing device (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A registration system for a printing device, comprising:

at least one sensor to detect a position of a print media;

at least one lead screw;

a first laterally adjustable rotating number and a second laterally adjustable rotating member coupled to the at least one lead screw, wherein the first laterally adjustable rotating member and the second laterally adjustable rotating member moves along an opposing lateral direction when the at least one lead screw is rotated;

a motor coupled to the at least one lead screw to move the first laterally adjustable rotating member and the second laterally adjustable rotating member a desired amount of movement based on the position of the print media and a width of the print media; and a processor communicatively coupled to the at least one sensor and the motor to calculate a desired amount of movement based on the position of the print media and control the motor to move the at least one lead screw to move the first laterally adjustable rotating member and the second laterally adjustable rotating member by the desired amount of movement.

2. The registration system of claim 1, wherein the at least one sensor comprises:

a pair of sensors located upstream from the first laterally adjustable rotating member and the second laterally adjustable rotating member to detect a skew of the print media; and a centerline sensor located upstream from the first laterally adjustable rotating member and the second laterally adjustable rotating member to detect a lateral position of the print media.

3. The registration system of claim 1, wherein the first laterally adjustable rotating member and the second laterally adjustable rotating member are on opposite sides of the at least one lead screw, wherein the at least one lead screw comprises two opposing pitch lines to move the first laterally adjustable rotating member and the second laterally adjustable rotating member in opposite directions as the at least one lead screw rotates.

4. The registration system of claim 3, wherein the first laterally adjustable rotating member and the second laterally adjustable rotating member are moved to have a spacing that is approximately equivalent to a width of the print media.

5. The registration system of claim 2, wherein the first laterally adjustable rotating member and the second laterally adjustable rotating member are on respective lead screws, wherein the respective lead screws are independently rotatable to spin the first laterally adjustable rotating member and the second laterally adjustable rotating member at different speeds to adjust the skew of the print media.

6. The registration system of claim 2, further comprising:

a second motor; and a movable registration carriage coupled to the second motor and communicatively coupled to the processor, wherein the second motor moves the movable registration carriage to align a centerline of the movable registration carriage with the centerline of the print media to adjust the lateral position of the print media.

7. A method for controlling a position of a print media in a registration system of a printing device, comprising:

detecting a position of a print media;

determining a width of the print media;

determining an amount of movement of a first laterally adjustable rotating member and a second laterally adjustable rotating member coupled to at least one lead screw based on the position and the width of the print media; and moving the at least one lead screw to move the first laterally adjustable rotating member and the second laterally adjustable rotating member in an opposing lateral direction along the at least one lead screw and in a rotational direction based on the amount of movement that is determined based on the position and the width of the print media.

8. The method of claim 7, wherein the opposing lateral direction comprises an inboard direction and an outboard direction.

9. The method of claim 7, wherein the amount of movement in the opposing lateral direction comprise a lateral distance to have a spacing between the first laterally adjustable rotating member and the second laterally adjustable rotating member that is approximately equal to the width of the print media.

10. The method of claim 7, wherein the position of the print media comprises a lateral position and a skew.

11. The method of claim 10, further comprising:

moving a registration carriage based on the lateral position to align a centerline of the registration carriage to a centerline of the print media.

12. The method of claim 10, wherein the moving in the rotational direction comprises rotating the two laterally adjustable rotating members at different speeds based on the skew.

13. The method of claim 10, wherein the moving the first laterally adjustable rotating member and the second laterally adjustable rotating member in the opposing lateral direction comprises moving the first laterally adjustable rotating member and the second laterally adjustable rotating member such that a spacing between the first laterally adjustable rotating member and the second laterally adjustable rotating member is approximately equal to a width of the print media.

* * * * *